United States Patent [19]

De Fraguier et al.

[11] Patent Number: 5,044,005

[45] Date of Patent: Aug. 27, 1991

[54] X-RAY TUBE WITH A FLAT CATHODE AND INDIRECT HEATING

[75] Inventors: Sixte De Fraguier, Grasse; Gilles Lemestreallan, Issy Les Moulineaux; Francois Caire, Gagny, all of France

[73] Assignee: General Electric CGR S.A., Issy Les Moulineaux, France

[21] Appl. No.: 373,886

[22] Filed: Jun. 30, 1989

[30] Foreign Application Priority Data

Jul. 1, 1988 [FR] France ..... 88 08962

[51] Int. Cl.[5] ..... H01J 35/06

[52] U.S. Cl. ..... 378/136; 378/137; 378/138

[58] Field of Search ..... 378/136, 137, 138

[56] References Cited

U.S. PATENT DOCUMENTS

| | | | |
|---|---|---|---|
| 3,916,202 | 10/1975 | Heiting et al. . | |
| 4,126,805 | 11/1978 | Randall | 378/138 |
| 4,344,011 | 8/1982 | Hayashi et al. | 378/138 |
| 4,730,353 | 3/1988 | Oro et al. | 378/138 |

FOREIGN PATENT DOCUMENTS

| | | | |
|---|---|---|---|
| 416533 | 6/1921 | Fed. Rep. of Germany . | |
| 2411487 | 8/1979 | France | 378/138 |
| 0108158 | 8/1980 | Japan | 378/138 |

OTHER PUBLICATIONS

Patent Abstracts of Japan, vol. 2, No. 64 (E-78) [2148], May 27, 1978, p. 2148 E 78, & JP-A-53 30 292.

Patent Abstracts of Japan, vol. 4, No. 157 (E-32) [639], Nov. 4, 1980, p. 131 E 32; & JP-A-55 108 158.

*Primary Examiner*—Carolyn E. Fields

*Assistant Examiner*—David P. Porta

*Attorney, Agent, or Firm*—Oblon, Spivak, McClelland, Maier & Neustadt

[57] ABSTRACT

Problems of thermal resistance of the cathode of an x-ray tube are solved by constructing a flat cathode in the form of a hollow beam. This ensures rigidity of the cathode which is inherent in its beam shape without being attended by the disadvantages of excessive thermal inertia.

9 Claims, 3 Drawing Sheets

101'
10'
102
91'
9'
92'
2
3
18
1
7
4
12
16
17
11
92
9
91
102
10
101
8
5
6

FT
50Kv
15
40Kv
14
20Kv
13
D

X-RAY TUBE WITH A FLAT CATHODE AND INDIRECT HEATING

BACKGROUND OF THE INVENTION

1. Field of the Invention

The present invention relates to an x-ray tube for use in particular in the medical field. The main characteristics of these tubes are resistance to drift of their emission characteristics as a function of their temperature as well as homogeneity of the x-ray illumination produced by all the points of their focus. The aim of the invention is to improve such tubes while guarding against any danger of destruction under the action of overheating of their anode or of their cathode.

2. Description of the Prior Art

In general terms, x-rays are produced by electron bombardment, within a vacuum enclosure, of a target fabricated from material having a high atomic number. The electrons which are necessary for bombardment of said target are liberated by thermoelectronic effect, usually in a helical filament of tungsten, of a cathode placed with precision within a concentration component. The concentration component performs a focusing function at the same time as a Wehnelt function. The target constitutes an anode of the x-ray tube. In this very conventional type of configuration, the initial velocities of the electrons at the level of the emitter are highly dispersed. The electron trajectory therefore has a disordered structure and the focusing system provides a correcting function but does not usually achieve sufficiently high performance characteristics. In consequence, instead of an impact of bombardment electrons on the target, there is obtained a fairly complicated entanglement of trajectories. This provides the thermal focus of the x-rays with an energy profile which is hardly compatible with good quality of the image.

In recent developments, for example in those described in European patent Application No. 85 106753.8 filed on May 31 1985, reference is made to a cathode which is no longer constituted by a filament but is now constituted by a portion of strip provided for emission of electrons with a flat surface located opposite to the anode. The advantage of employing a flat electron emitter has already been presented prior to this Application. It consists in maintaining a certain cohesion of the electronic charges during their trajectory towards the target. Experience has in fact shown that there is obtained in this case a distribution of electrostatic potential which is conducive to better focusing of the electric charges. The x-ray focus thus obtained accordingly exhibits a practically homogeneous energy profile which has a favorable effect on the quality of the image. The scientific literature records certain experiments which are based on this general principle and in which use is always made of an emitter constructed in the form of a tungsten strip. However, these strips are systematically attended by problems of thermomechanical strength. It was in fact with a view to solving such problems that the European patent Application cited above was filed. In particular, in spite of all the care and attention devoted to rolling of the strips, these strips are subjected to differential stress phenomena and, as a result of successive heating and cooling within the x-ray tube, acquire a so-called corrugated-sheet appearance. The advantages arising from the use of a flat emitter are then lost.

The object of the present invention is to overcome this disadvantage by proposing a flat emitter device which offers high mechanical strength and thus makes it possible to remove the corrugated-sheet problems mentioned earlier. To simplify, the emitter is constituted by a beam. This beam is preferably of hollow construction and may have a substantially rectangular cross-section. It is thus possible to benefit by all the advantages offered by the rigidity of a beam, such rigidity being substantially greater than that of a strip. Furthermore, in order to avoid the need to heat an excessively large mass of material, the beam is of hollow construction. In respect of a given heating power, this reduces the turn-on time of the x-ray tube. In one improvement, the hollow beam is even traversed by a helical heating coil from one side to the other and the beam is thus heated by indirect heating. This indirect heating can even be focused only on predetermined portions of the beam, especially the beam face located opposite to the anode. This permits a further limitation of the heating power.

SUMMARY OF THE INVENTION

The invention is therefore directed to an x-ray tube provided with a cathode and an anode opposite to the cathode for emitting x-radiation, the cathode being a flat cathode, said cathode being essentially constituted by a beam.

DETAILED DESCRIPTION OF THE INVENTION

Figure 1:
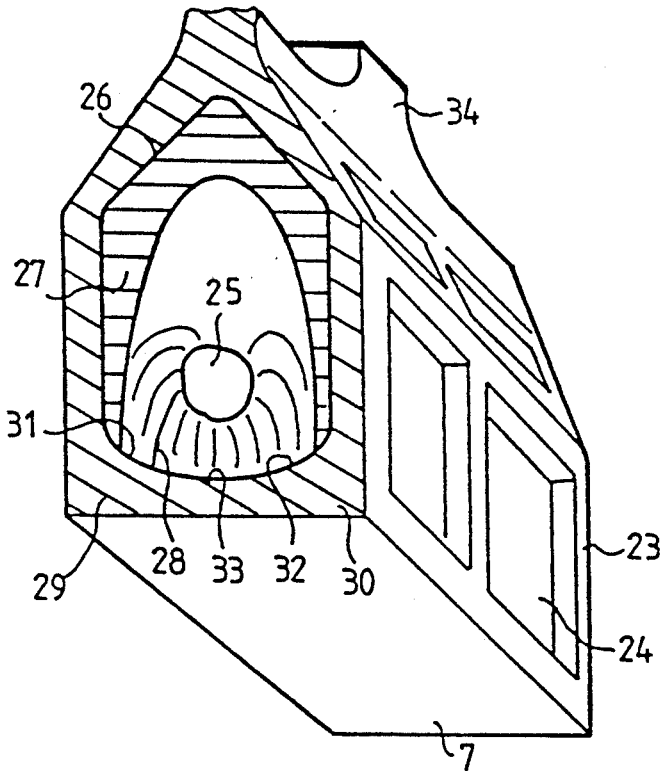
FIG. 1 is a perspective view of a beam cathode in accordance with the invention.
Figure 2:
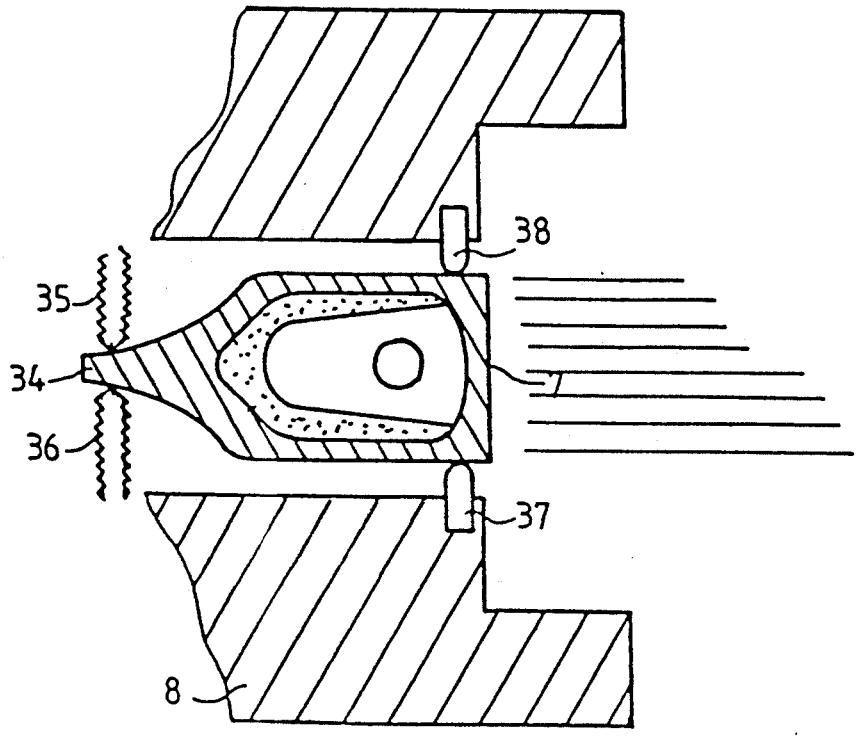
FIG. 2 is a sectional view of the cathode of FIG. 1.

In accordance with the invention a cathode 1 has the appearance of a beam as shown in perspective in FIG. 1. This beam is prismatic, of hollow construction, and has substantially the shape of a house. The base of the house constitutes an emissive face 7 of the cathode, the walls of the house such as the wall 23 have windows such as the window 24. The advantage of constructing a hollow beam lies in the reduction of the quantity of metal to be heated. If this quantity is smaller, the thermal inertia of the cathode is lower and turn-on of the x-ray tube can be faster. Moreover, the consumption of heating power supplied to the cathode can be reduced, which is an advantage when considering the insulation problems which have to be faced in the heating circuits of cathodes of this type.

Although it would be possible to contemplate direct heating of this cathode by passing an electric current directly through this latter, it is preferred to employ a heating filament 25, for example of the same type as heating elements employed in the present state of the technique as emitters. This heated filament is brought to a high negative voltage (several thousand volts) with respect to the cathode. In a preferred example, the beam cathode is made of tungsten. In order to ensure that the quantity of thermal energy to be delivered for heating the cathode is also limited, the ceiling 26 and the interior of the walls of said cathode are provided with a mattress 27 of heat-insulating fibers in order to concentrate the heating on the emissive portion of the cathode.

In one example, the fibers are ceramic fibers which permit good insulation of the internal walls of the house. Accordingly, the electrons emitted by the heating filament bombard the rear portion of the cathode in a pattern represented by the electric field curves 28. This bombardment is limited to the front wall 33. Moreover, said front wall has a concave profile 33. In a preferred example, this profile is even concave to such an extent that wings 29 and 30 respectively of said cathode have internal faces 31 and 32 respectively which are closer to the filament 25 than the internal face of the cathode at its midpoint 33. Thus the wings which are of greater thickness and which would be more difficult to heat are nevertheless heated to a greater extent. Thus the base 7 of the beam is brought to a substantially constant temperature at all points and the required radiation of electrons is emitted at a substantially constant rate.

Although the beam in accordance with the invention now offers an advantage in that its emissive face 7 is no longer subject to distortion under the action of overheating, the beam is nevertheless subject to expansions which have to be guided without restraining them. To this end, the cathode is attached by means of a single lug 34 which virtually constitutes the chimney of the house. The mode of attachment is preferably obtained by locking said lug 34 between two clamping screws 35 and 36 respectively. This assembly with a single point of attachment has the advantage of providing the cathode with all the degrees of freedom which may be desired. It is preferable in particular to a two-point mode of attachment which would be attended by a disadvantage in that the reactions between the two points would inevitably produce harmful effects on the flatness of the emissive surface 7. In order to guide the displacements of the cathode with the temperature, the walls of said cathode are maintained within a focusing member 8 by ceramic studs such as the studs 37 and 38 which are applied against said member on each side. This serves to guard against any phenomenon of bending or vibration which would have an unfavorable effect on accurate positioning of the emitter within the focusing member. The studs permit thermal expansion of the emitter along its greatest length while maintaining it laterally in its reference position. In practice, the supply of electric power to the cathode can be obtained by passing the high voltage through the screws 35 or 36.

Figure 3:
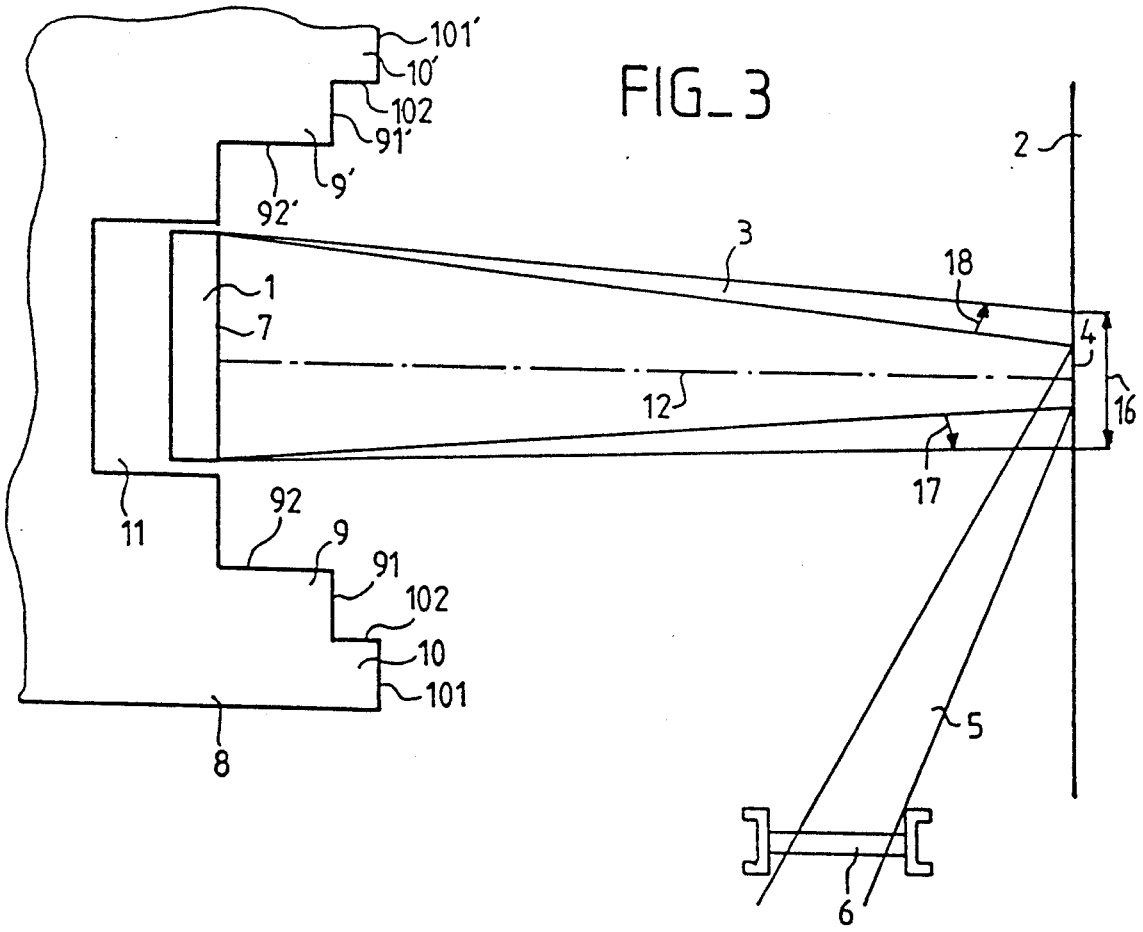
FIG. 3 is a schematic sectional view of an x-ray tube provided with a beam in accordance with the invention.

FIG. 3 shows diagrammatically an x-ray tube provided with a beam-cathode 1 in accordance with the invention. Said x-ray tube is provided within a vacuum enclosure (not shown) with the cathode 1 located opposite to an anode 2. The anode receives an electron radiation 3 on its focus 4 and re-emits an x-radiation 5 which is directed in particular to a utilization window 6. The utilization window forms part of the tube envelope. In accordance with the invention, a distinctive feature of the cathode lies in the fact that a flat face 7 is located opposite to the anode 2. Another feature is that said cathode is inserted in a so-called stair-step optical focusing device 8. The object of this stair-step optical device is to produce a distribution of the electric field between the anode and the cathode such that the electron radiation 3 is of the convergent type. Two types of convergent radiation are distinguished. In a first type shown in FIG. 3, the point of convergence of the electrons is located behind the plane of the anode and is virtual. In this case, the radiation is known as direct. In a second type of radiation or so-called crossed radiation, the point of convergence of the electrons is located in the intermediate position between the cathode 7 and the anode 2 and is real.

Although the focusing device 8 can consist of a single step, it has been found more advantageous in this case to provide a double step. The focusing member 8 has a prismatic shape as shown in the right section plane of FIG. 3. The member 8 has two stair-steps designated respectively by the references 9 and 10 and distributed symmetrically at 9' and 10' on each side of the cathode 1. Each stair-step has a top face or "tread" 91 or 101 and a riser 92 or 102 (respectively 91', 92', 101', 102'). In a preferred example of construction, the plane 7 of the cathode 1 is located at a distance of approximately 7.5 mm from the anode 2. The treads 91 and 91' of the steps 9 and 9' are located at a distance of approximately 7 mm from the anode. The treads 101 and 101' are located at a distance of approximately 6 mm from the plane of the anode 2. The width of the cathode 1 as measured in the right section plane of the prismatic focusing member 8 has a value of 2 mm. The width of a housing 11 in which said cathode is placed within the focusing member 8 has a value of 2.2 mm. The distance between the risers 92 and 92' is 4 mm whilst the distance between the risers 101 and 102' is 5 mm. Preferably, the device has a symmetrical shape with respect to a plane which passes through the radiation axis 12 at right angles to the plane of the figure. By way of alternative, however, instead of being prismatic, the assembly can be circular and the axis 12 serves as an axis of revolution for the cathode as well as for the focusing member. The anode 2 may possibly be an anode of the rotating type and may even have a face which is inclined to the axis 12. In this case, the distances indicated are rather the distances measured on said axis 12 between the plane 7 of the cathode and the trace of the axis 12 on the anode 2.

Figure 4:
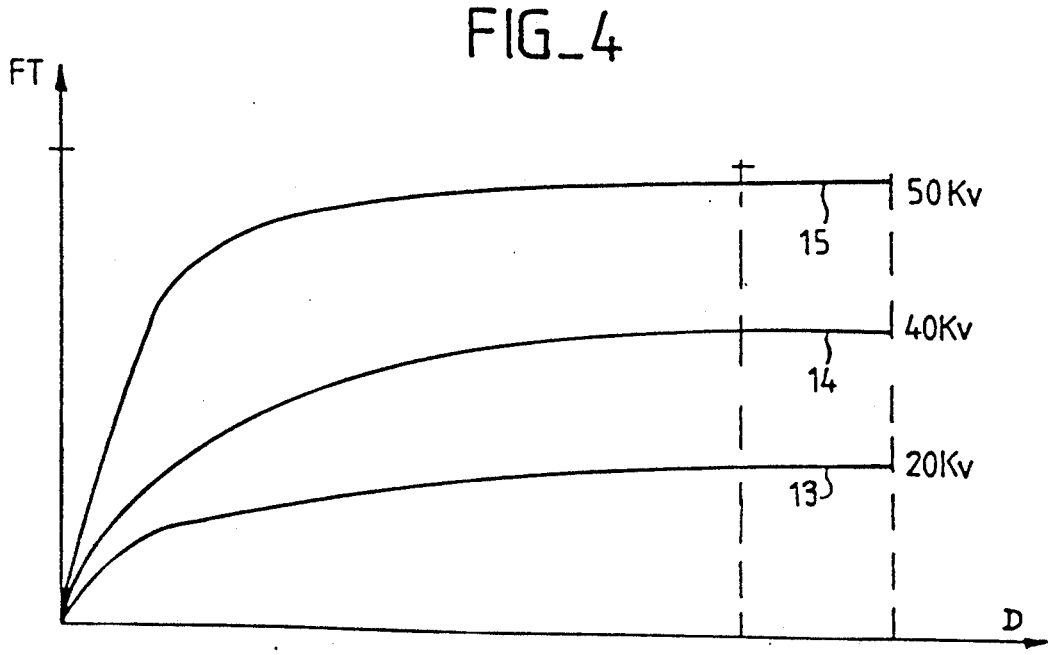
FIGS. 4 and 5 are energy diagrams relating to the x-ray tube of FIG. 3.

The dimensions given in the foregoing have an advantage in that the thermal flux FT (FIG. 4) is in this case substantially constant in respect of a given utilization high voltage, as a function of the load D on the tube. In fact, the diagram of FIG. 4 shows three curves 13 to 15 respectively having high voltage parameters of 20 KV, 40 KV or 50 KV indicating a substantially flat course within a utilization range located between 150 milliamperes and 500 milliamperes. The thermal flux is expressed in KW per $mm^2$. In the example considered, the thermal flux is always less than 50 KW per $mm^2$, even at the highest utilization high voltage. The flat appearance of said thermal flux as a function of the load means quite simply that the dimension 16 of the thermal focus varies linearly with the load. In fact, if the load increases, for example to double the value, the dimension 16 increases and the emitted x-ray power also increases to double the value without producing any abnormal local thermal stresses on the anode. This increase in load causes a relative outward displacement of the lateral directions of the electron beam 3 in the direction of the arrows 17 and 18. The beam becomes more and more direct.

Although the dimension of the focus changes when the load changes, the advantage of the solution considered is related to the fact that a focus of predetermined dimension is thus made available in a simple manner. In fact, the curves 13 to 15 are regular curves without undulation. In consequence, in particular in metrology, when the problem of dose rate is not a crucial point or even in medicine when the limits of irradiation are not overstepped, it is possible to choose a desired dimension of focus as a function of sharpness of detail of the image to be produced. A simple means has thus been presented for adjusting the dimension of said focus to a suitable value.

Figure 5:
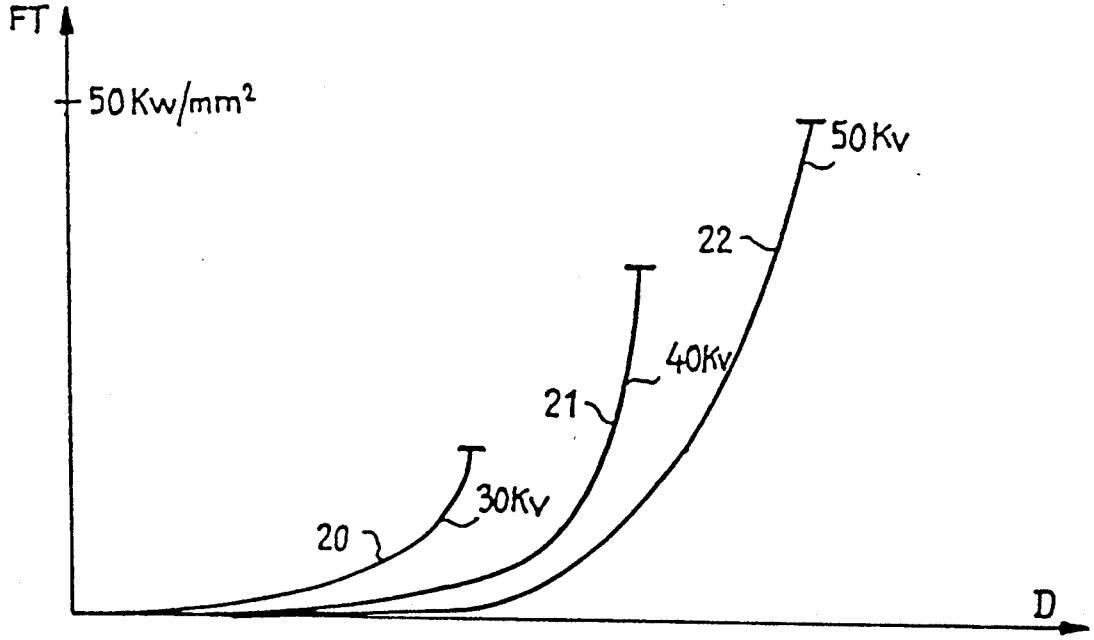

In another example in which the radiation 3 is convergent and converges to a point of convergence placed in front of the anode, the increase in the dose rate causes displacement of the point of convergence in the direction of the anode 2. In this radiation of the crossed type, the angular divergence 17, 18 of the lateral rays of the x-radiation beam before the point of convergence results conversely in narrowing of the dimension 16 of the focus. It has been discovered that, although this narrowing effect could be disastrous, it is in fact limited by a phenomenon of saturation of emission of the electrons detached from the top face 7 of the cathode 1. In fact, by reason of the concentration, the space charge which naturally has a tendency to increase with the load on the x-ray tube (there is a greater number of electrons) increases to such a point as to constitute under certain conditions a screen for emission of the following electrons. This space charge virtually acts as a grid. It has been discovered that this phenomenon could be employed as a self-regulation function on condition that a special optical focusing device is chosen. This optical focusing device is of the same type as the device described in the foregoing and is provided with stair-steps. As before, the above-mentioned phenomenon has the advantage of taking place irrespective of the utilization high voltage of the x-ray tube. Understandably, this saturation phenomenon produces a saturation thermal flux on the focus, the value of which depends on said high voltage. In fact, if the high voltage is low, the electrons are relatively less accelerated and the saturation space charge occurs more rapidly. Thus a saturation "bottleneck" is created more readily as the electrons travel at lower velocity. Moreover, it is of interest to note that the curves 20 to 22 (FIG. 5) showing the different effects of this saturation phenomenon on the thermal flux have a limited course as saturation is approached. This means that, at the moment of saturation, the output can no longer increase but above all that the thermal flux can no longer increase. By correctly choosing the anode and cathode materials or the conditions of utilization of the x-ray tubes in such a manner as to ensure that the saturation point is not located outside operating tolerances, the requisite result is obtained.

What is claimed is:

1. An X-ray tube comprising a cathode and an anode inside a vacuum enclosure, said anode being located opposite said cathode, said cathode being made of a hollow beam having lateral walls and a flat emitting area facing said anode.

2. An X-ray tube according to claim 1, wherein said flat emitting area is heated by an indirect heating device located inside said hollow beam.

3. An X-ray tube according to claim 2 wherein said heating device comprises a heating filament disposed longitudinally inside said hollow beam and a mattress of fibers disposed on the internal part of said lateral walls on the internal portion of said hollow beam corresponding to said flat emitting area.

4. An X-ray tube according to claim 3 wherein said internal portion of said hollow beam corresponding to said flat emitting area has a concave shape with wings that are closer to said heating filament than the central point of said concave internal portion of said hollow beam.

5. An X-ray tube according to claim 1, wherein at least one of the lateral walls of said hollow beam is provided with at least one hollow-out portion.

6. An X-ray tube according to claim 1, wherein said hollow beam is secured to said enclosure of said X-ray tube by means of a single point of attachment.

7. An X-ray tube according to claim 1, wherein said hollow beam is placed at the base of a focusing device.

8. An X-ray tube according to claim 7, wherein said hollow beam is guided by ceramic studs which are attached on each lateral wall of said hollow beam as well as on said focusing device.

9. An X-ray tube according to claim 7, wherein, said flat emitting area of said cathode is located at a distance of approximately 7.5 millimeters from said anode.

* * * * *